US006684540B1

(12) United States Patent
Tufts

(10) Patent No.: US 6,684,540 B1
(45) Date of Patent: Feb. 3, 2004

(54) WALL-MOUNTED SELF-STORING IRONING BOARD

(75) Inventor: Norman J. Tufts, Broken Arrow, OK (US)

(73) Assignee: Hide-Away Ironing Boards, Inc., Broken Arrow, OK (US)

( * ) Notice: Subject to any disclaimer, the term of this patent is extended or adjusted under 35 U.S.C. 154(b) by 0 days.

(21) Appl. No.: 10/191,929

(22) Filed: Jul. 9, 2002

(51) Int. Cl.[7] ..... D06F 81/06
(52) U.S. Cl. ..... 38/137
(58) Field of Search ..... 38/137, 138, 139; 108/48, 47, 173, 117, 120; 16/87 R, 87.6 R, 96 R, 90, 94, 95 R

(56) References Cited

U.S. PATENT DOCUMENTS 1,790,468 A * 1/1931 Frank et al. ..... 108/38
4,862,811 A * 9/1989 Davis ..... 108/134
4,868,935 A * 9/1989 Van Weelden ..... 4/610
4,995,681 A * 2/1991 Parnell ..... 312/242
5,022,197 A * 6/1991 Aragona ..... 52/29
5,855,350 A * 1/1999 Volker et al. ..... 248/430
6,182,935 B1 * 2/2001 Talesky ..... 248/436

OTHER PUBLICATIONS

Brochure: "Introducing the Chairman of the Board" by Hide–Away Ironing Boards.

* cited by examiner

*Primary Examiner*—Ismael Izaguirre
(74) *Attorney, Agent, or Firm*—Frank J. Catalano

(57) ABSTRACT

A self-storing ironing board has a casing with oppositely disposed tracks in lower portions of its side walls. A horizontal rod is fixed to one end of a platform with the ends of the rod extending to the tracks. A linkage connects an intermediate portion of the platform to a lower end of the casing. As the rod slides in the tracks, the platform rotates between a horizontal ironing position and an almost vertical storage position. The center of gravity of the combined linkage and platform passes rearwardly of the rotational axis as the platform approaches the almost vertical storage position. A pair of lining inserts disposed in the tracks and slidably engaged with the rod ends have a coefficient of friction such that the platform is gravitationally pulled into and held in its almost vertical storage position when the center of gravity passes rearwardly of the rotational axis.

4 Claims, 4 Drawing Sheets

WALL-MOUNTED SELF-STORING IRONING BOARD

BACKGROUND OF THE INVENTION

This invention relates generally to ironing boards and more particularly concerns wall-mounted, self-storing ironing boards.

Known wall-mounted, self-storing ironing boards have a wooden casing sized to fit into the space between household wall studs which typically are on 16" centers. The casing is covered by a hinged door. A linkage is hinged between the lower portion of the ironing platform and the bottom of the casing. A steel rod fixed to the lower end of the platform has ends which are disposed in vertical tracks routed into the lower side walls of the wooden casing. When the platform is lowered into its horizontal use position or raised into its vertical storage position, the ends of the steel rod slide in frictional engagement in the wooden tracks.

One major problem with these known self-storing ironing boards is that the rod does not slide smoothly in the tracks. In order to facilitate the sliding motion of the steel rod in the wooden tracks, the ends of the rod are sometimes fitted with Teflon caps and the wood surfaces of the tracks are waxed. This solution is temporary at best because the caps wear out and the tracks need frequent waxing and worn caps or uneven dispersion of wax causes the rod to stutter as it slides. If the stutter is alternating from side to side, the rod will shimmy in the casing. Consequently, raising and lowering the platform can be a tedious and irritating experience and even cause damage to the structure of the ironing board.

Another major problem results from the depth of the casing being limited by the thickness of the wall in which it is mounted. This limitation is accentuated because the iron is typically stored on a heat-shielded shelf in the casing. The front edge of the shelf prevents rotation of the platform to a fully vertical condition in the shallow casing, so the platform tends to fall out of the casing. In some known devices, the center of gravity of the combined pivoting components happens to be positioned so that it is slightly rearward of the pivot hinge when the platform is tilted forward from vertical. However, since the rod does not slide smoothly in the tracks, the center of gravity frequently does not reach the crossover point beyond which the platform would tend to rotate into the casing rather than out of the casing. Consequently, in order to assure that the platform does not free fall into its horizontal position when the door is opened, a latch is required to secure the platform to the casing in the vertical storage position.

It is, therefore, an object of this invention to provide a wall-mounted, self-storing ironing board which is so narrow and shallow as to be mounted between the studs of a residential wall. Another object of this invention is to provide a wall-mounted, self-storing ironing board which rotates smoothly between a horizontal use position and an almost vertical storage position. A further object of this invention is to provide a wall-mounted, self-storing ironing board which tends to automatically rotate into its casing as it approaches its almost vertical storage position. Yet another object of this invention is to provide a wall-mounted, self-storing ironing board which uses no components which require replacement due to wear incurred during sliding engagement of the platform rod in its guide tracks. It is also an object of this invention to provide a wall-mounted, self-storing ironing board which requires no waxing of the guide tracks in which the platform rod is slidably engaged.

Still another object of this invention is to provide a wall-mounted, self-storing ironing board which requires no latch to maintain the platform in its almost vertical storage position. And it is an object of this invention to provide a wall-mounted, self-storing ironing board which has a platform which is gravitationally held in its almost vertical stage position.

SUMMARY OF THE INVENTION

In accordance with the invention, a wall-mounted, self-storing ironing board is provided which has a shallow, narrow, open fronted casing with oppositely disposed inverted L-shaped tracks in lower portions of its side walls. An elongated platform extending along a lengthwise axis has a horizontal rod fixed to one end of the platform which is perpendicular to the axis. The ends of the rod are slidably disposed in the tracks. A linkage is connected between an intermediate portion of the platform by a first hinge and a lower end of the casing by a second hinge. As the rod slides in the tracks, the platform rotates between a horizontal ironing position with the platform extending forward of the casing and an almost vertical storage position with the platform contained in the casing. The linkage is configured so that the center of gravity of the linkage and platform taken together passes rearwardly of the rotational axis of the second hinge as the platform approaches the almost vertical storage position. A pair of lining inserts are disposed in the tracks and slidably engage with the rod ends. The coefficient of friction between the inserts and the rod ends is such that the platform is gravitationally pulled into its almost vertical storage position when the center of gravity passes rearwardly of the rotational axis of the second hinge. Preferably, the rod is a steel tube and the inserts are made of molded plastic.

In a preferred embodiment, the horizontal rod is fixed to one end of a turntable and end of the elongated platform overlaps the turntable. A pivot pin connecting the platform to the turntable allows the platform to be rotated in a plane parallel to the turntable so that the platform can be rotated at angles in relation to the wall on which the board is mounted. In this embodiment, the linkage is connected between an end of the turntable and the lower end of the casing and is aligned so that the center of gravity of the linkage, the turntable and the platform taken together passes rearwardly of the rotational axis of the second hinge as the platform approaches its almost vertical storage position.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
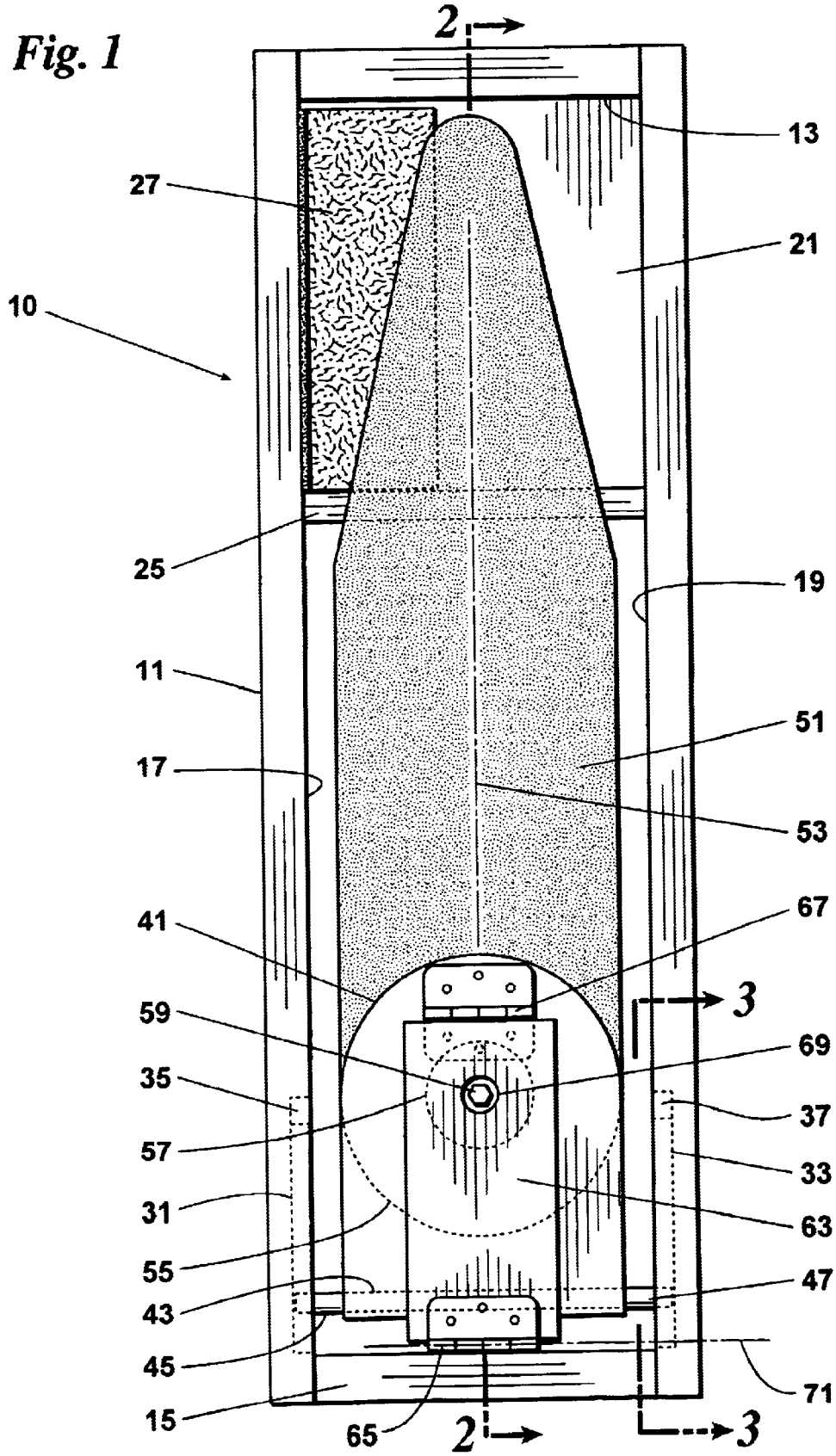
FIG. 1 is a front elevation view of a preferred embodiment of the wall mounted self-storing ironing board.
Figure 2:
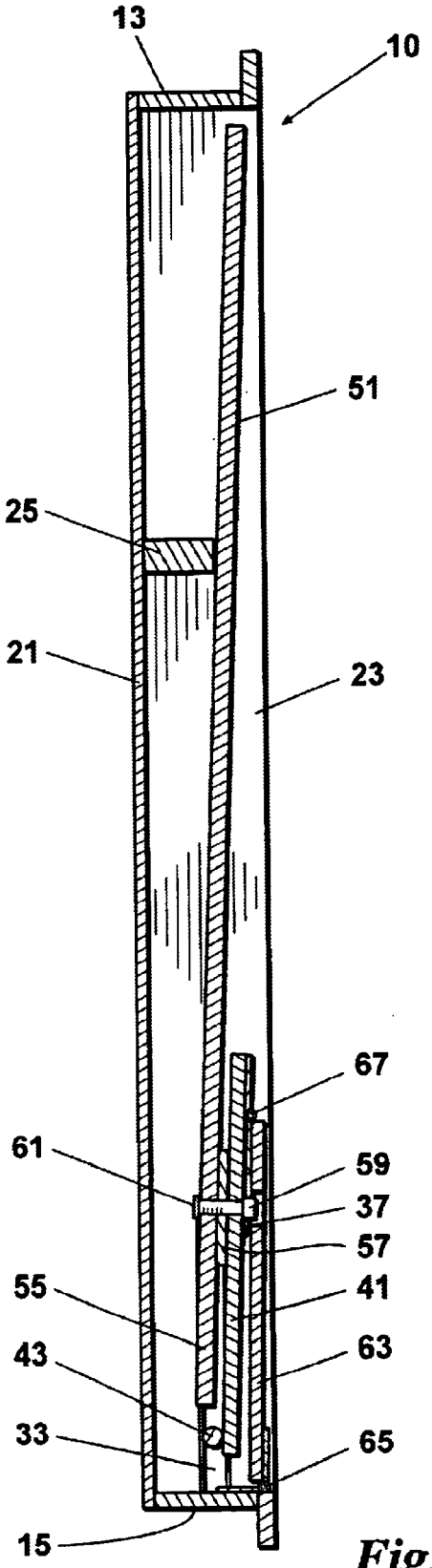
FIG. 2 is a cross-sectional view taken along the line 2—2 of FIG. 1.

Turning first to FIGS. 1 and 2, a wall-mounted, self-storing ironing board 10 is illustrated. The ironing board 10 consists of a casing 11 having a top wall 13, a bottom wall 15, left and right side walls 17 and 19 and a back wail 21. The board 10 also has an open front 23 which may be closed by a door (not shown). The casing 11 is sized to be so shallow and narrow as to fit in the space between residential wall studs with the back of the door flush against the front of the wall. A shelf 25 is provided in the upper portion of the ironing board 10 to support an iron and supplies associated with ironing (not shown). Preferably, the shelf space intended for storage of the iron is protected by a heat shield 27 guarding the portions of the side wall 17 and back wall 21 above the shelf 25.

Figure 3:
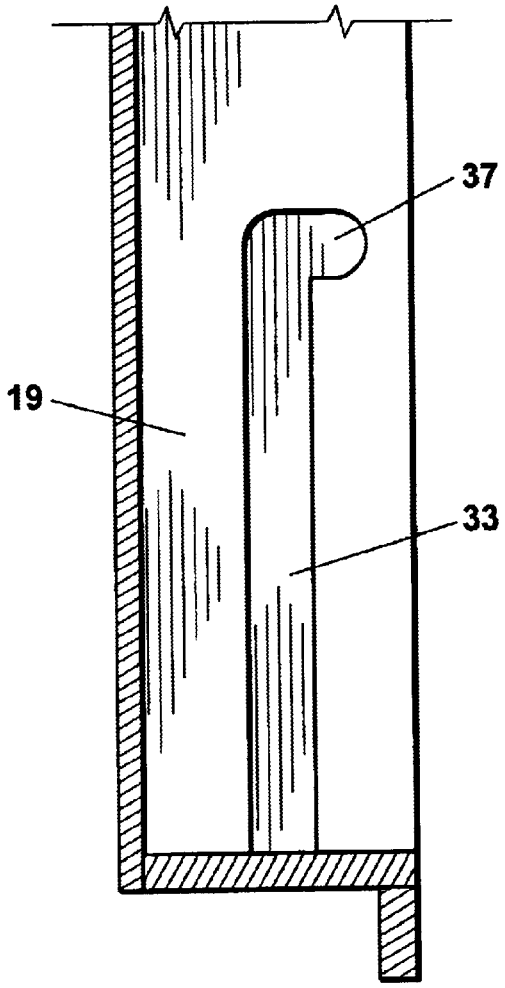
FIG. 3 is a cross-sectional view taken along the line 3—3 of FIG. 1.

As can best be seen in FIG. 3, the side walls 17 and 19 have tracks 31 and 33 routed in their inner faces. The tracks 31 and 33 have an inverted L-shape with their extensions 35 and 37 extending forwardly for reasons hereinafter explained.

Returning to FIGS. 1 and 2, the preferred embodiment of the ironing board 10 has a turntable 41 which fits into the lower portion of the cavity in the casing 11. The turntable 41 has a rod 43 fixed to its lower end, such as by screws (not shown). The rod 43 extends horizontally across the casing 11 and the ends 45 and 47 of the rod 43 are slidably disposed in the tracks 31 and 33 in the side walls 17 and 19 of the casing 11. An elongated ironing platform 51 extends along a longitudinal axis 53. The platform 51 is shaped to fit comfortably within the casing 11 and one end 55 of the platform 51 overlaps the turntable 41. A spacer 57, which is relatively small in comparison to the overlapped area of the turntable 41 and platform 51, is disposed between the turntable 41 and the platform 51. A pivot pin such as a bolt 59 extends through the turntable 41, the spacer 57 and the platform 51 to a nut 61. This arrangement permits the platform 51 to be rotated horizontally on the turntable 41 by manual application of a rotating force to the platform 51. However, the bolted relationship of the components prevents inadvertent rotation of the platform 51 in relation to the turntable 41. As shown, the forward or upper end of the turntable 41 and the rear or bottom end 55 of the platform 51 are cut to form a circle so that, as the platform 51 is rotated on the turntable 41, the exposed edges will always be smooth.

In the preferred embodiment above described, rotation of the platform 51 is possible. If rotation is not desired, the turntable 41, spacer 57, bolt 59 and nut 61 can be eliminated so that the rod 43 is fastened directly to the platform 51. Essentially, the turntable 41 and platform 51 become an integral member with no horizontal rotating capabilities.

Figure 7:
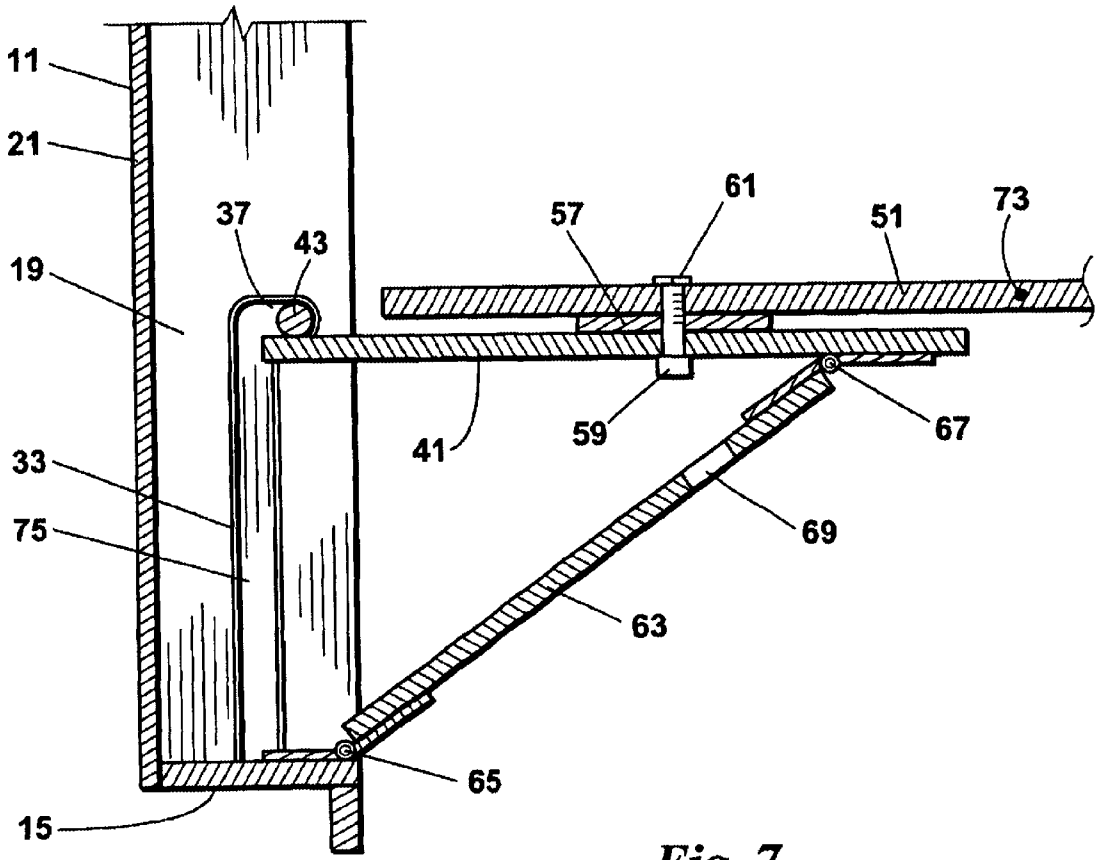
FIG. 7 is a side elevation view illustrating the ironing board of FIG. 1 in its horizontal use position.
Figure 6:
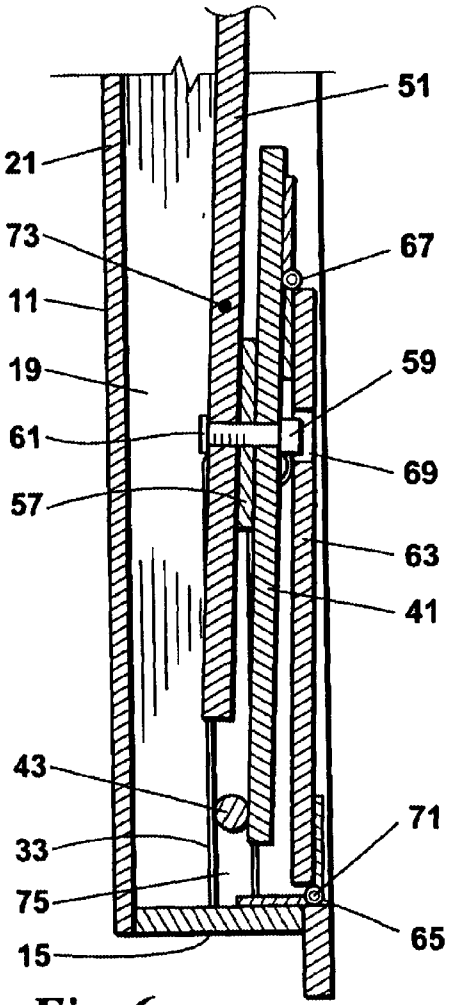
FIG. 6 is a side elevation view illustrating the platform of the ironing board of FIG. 1 in its almost vertical stored position in its casing.

As best seen in FIGS. 1, 6 and 7, a linkage 63 has one end connected by a first hinge 65 to the bottom wall 15 of the casing 11 and another end connected by a second hinge 67 to the forward end of the turntable 41. If horizontal rotation of the platform 51 were not required, the second hinge 67 would be connected directly to an intermediate point along the platform 51, the turntable 41, spacer 57, bolt 59 and nut 61 having been eliminated. In the preferred embodiment shown, the linkage 63 is provided with a hole 69 to accommodate the nut 61 when the platform 51 is stored as shown in FIG. 6.

Looking at FIGS. 6 and 7, the operation of the ironing board 10 can be understood. In FIG. 6, the ironing board 10 is shown with the platform 51 in its almost vertical storage position in the casing 11. In this position, the platform 51 is tilted forwardly and, as best seen in FIG. 2, in abutment with the shelf 25. The spacer 57, turntable 41 and linkage 63 are collapsed and the rod 43 is at the lowest point in its path of travel sliding in the tracks 31 and 33. In the configuration shown, the pivot axis 71 of the first hinge 75 is forward of the forward most of the pivoting components, the linkage 63. As best seen in FIG. 6, the axis 71 is substantially at the forward edge of the casing 11. Clearly then, the center of gravity of the hinged components taken together, including the platform 51, spacer 67, turntable 41 and linkage 63, are to the rear of the pivot axis 71. For description's sake, a center of gravity 73 has been approximated. If the center of gravity 73 passes behind the pivot axis 71 of the hinge 65, the tendency of the combined components will be to rotate into the casing 11 under the force of gravity to hold the platform 51 in abutment with the shelf 25. However, the frictional forces resulting from the sliding motion of the rod 43 in the tracks 31 and 33 may overcome the gravitational force and prevent free rotation into abutment with the shelf 25. It would, therefore, be necessary to manually urge the platform 51 into this position and even to latch the platform 51 in this position to assure that it does not free fall into its horizontal position.

Figure 4:
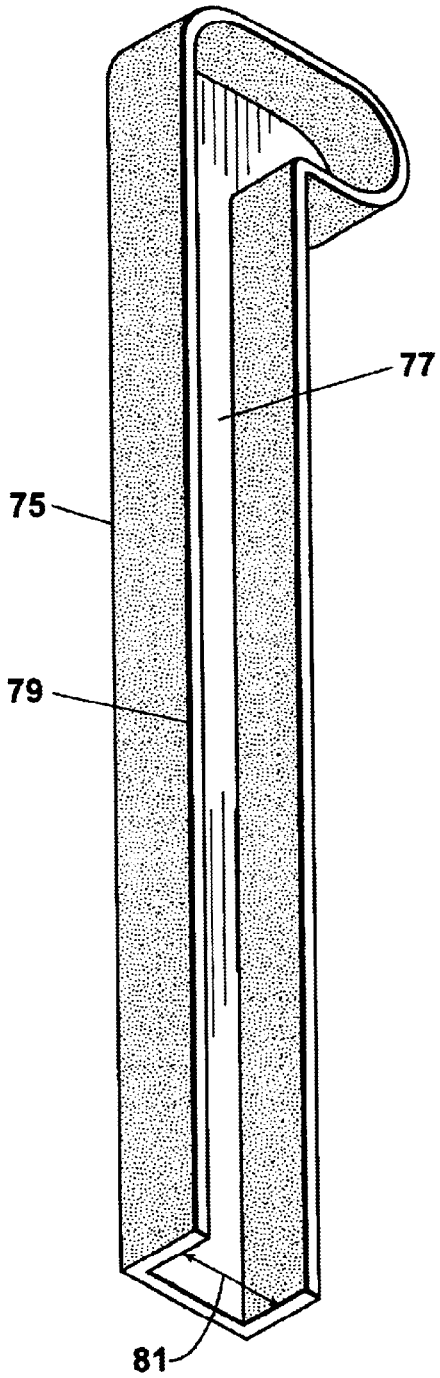
FIG. 4 is a perspective view illustrating a preferred embodiment of inserts for the tracks in the ironing board of FIG. 1.
Figure 5:
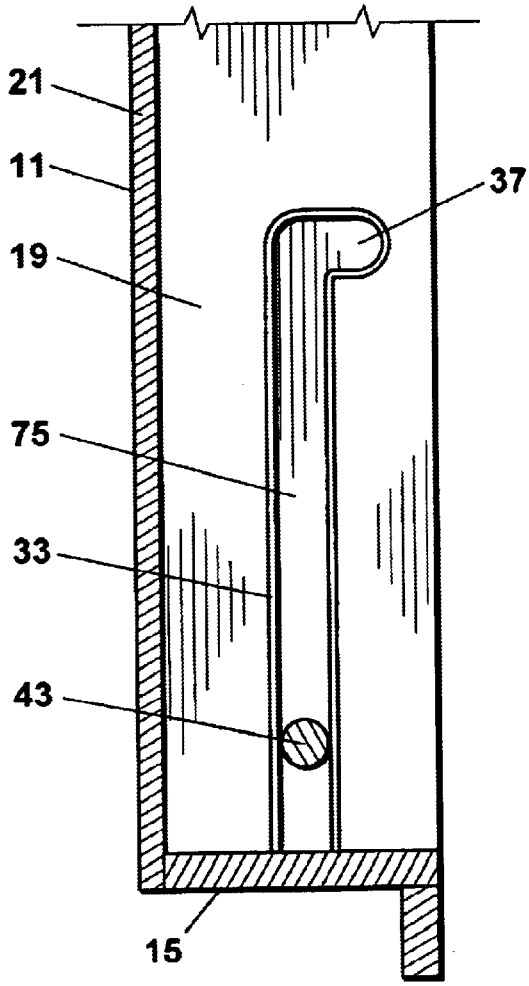
FIG. 5 is a side elevation view illustrating the insert of FIG. 4 disposed in the routed track in the side wall of FIG. 3.

To overcome the problem as shown in FIG. 4, an insert 75 is configured to be press-fitted into the track 33 shown in FIG. 3. The insert 75 has a side wall 77 and a rail 79 along its perimeter. As shown in FIG. 5, the insert 75 is fit into the track 33 in the right side wall 19 of the casing 11 and the right end 47 of the rod 43 is slidably engaged in the insert 75 so that the circumference of the rod 43 slides against the rail 79. The materials of the rod 43 and the insert 75 are chosen so that the coefficient of friction between them will not allow the force of gravity which would pull the platform 51 into its almost vertical position as shown in FIG. 6 to be overcome. In practice, it has been found that a steel pipe of 23/32" diameter used for the rod 43 and molded plastic used for the insert 75 with a space 81 of ¾" separating the vertical portions of the rail 79 work effectively to this purpose. A mirror opposite of the insert 75 illustrated in FIG. 4 is inserted in the left-side track 31.

Turning now to FIG. 7, the platform 51 is illustrated in its horizontal position for use in ironing. To transfer the stored platform 51 into its usable position illustrated in FIG. 6, the upper end of the platform 51 is pulled outwardly and downwardly. This causes the linkage 63 to hinge with respect to the bottom wall 15 of the casing 11 and the turntable 41. As the hinges 65 and 67 rotate, the rod 43 slides upwardly in the inserts 75 of the tracks 31 and 33 until the rod engages the inserts 75 in the upper ends of the tracks 31 and 33. The distance to the top of the tracks 31 and 33 is selected so that, with the rod 43 in this position, the platform 51 is in its horizontal use position. In this position, the force at the center of gravity 73 causes the rod 43 to shift forward in the inserts 75 into the track extensions 35 and 37. This secures the platform 51 in its horizontal use position. As can best be seen in FIG. 7, in this position the platform 51 can be rotated horizontally about the pivot pin formed by the bolt 59 and nut 61 so that the angular position of the platform axis 53 can be changed in relation to the casing 11.

In returning the platform 51 into its stored position, upward force on the forward portion of the platform 51 causes the hinges 65 and 67 to operate. The rod 43 shifts rearwardly into the vertical portions of the inserts 75 and then slides downwardly in the inserts 75 under the continued application of manual force against the platform 51. When the center of gravity 73 crosses over the pivot axis 71 of the first hinge 65, the low coefficient of friction between the rod 43 and the inserts 75 allows the platform 51 to rotate without further application of manual force into its almost vertical stored position with the platform 51 abutting the shelf 25.

Thus, it is apparent that there has been provided, in accordance with the invention, a wall-mounted, self-storing ironing board that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A wall-mounted, self-storing ironing board comprising:

a shallow, narrow, open fronted casing having oppositely disposed inverted L-shaped tracks in lower portions of side walls thereof;

an elongated platform extending along a lengthwise axis;

a horizontal rod fixed to one end of said platform and perpendicular to said axis, said rod having ends slidably disposed in said tracks;

a linkage connected between an intermediate portion of said platform by a first hinge and a lower end of said casing by a second hinge for rotation of said platform as said rod slides in said tracks between a horizontal ironing position with said platform extending forwardly from said casing and an almost vertical storage position with said platform contained in said casing, said linkage being configured so that a center of gravity of said linkage and said platform taken together passes rearwardly of a rotational axis of said second hinge as said platform approaches said almost vertical storage position; and a pair of lining inserts, one disposed in each of said tracks and slidably engaged with said rod ends, a coefficient of friction between said inserts and said rod ends being such that said platform is gravitationally pulled into said almost vertical storage position when said center of gravity passes rearwardly of said rotational axis of said second hinge.

2. A wall-mounted, self-storing ironing board according to claim 1, said rod being a steel tube and said inserts being plastic.

3. A wall-mounted, self-storing ironing board comprising:

a shallow, narrow, open fronted casing having oppositely disposed inverted L-shaped tracks in lower portions of side walls thereof;

a turntable;

a horizontal rod fixed to one end of said turntable, said rod having ends slidably disposed in said tracks;

an elongated platform extending along a lengthwise axis and having one end portion thereof overlapping said turntable;

a pivot pin connecting said platform to said turntable for rotation in a plane parallel thereto;

a linkage connected between an intermediate portion of said turntable by a first hinge and a lower end of said casing by a second hinge for rotation of said turntable as said rod slides in said tracks between a horizontal ironing position with said platform extending forwardly along said platform axis from said casing and an almost vertical storage position with said platform contained in said casing, said linkage being configured so that a center of gravity of said linkage, said turntable and said platform taken together passes rearwardly of a rotational axis of said second hinge as said platform approaches said almost vertical storage position; and a pair of lining inserts, one disposed in each of said tracks and slidably engaged with said rod ends, a coefficient of friction between said inserts and said rod ends being such that said platform is gravitationally pulled into said almost vertical storage position when said center of gravity passes rearwardly of said rotational axis of said second hinge.

4. A wall-mounted, self-storing ironing board according to claim 3, said rod being a steel tube and said inserts being plastic.

* * * * *